United States Patent [19]

Herth et al.

[11] 4,326,488

[45] Apr. 27, 1982

[54] SYSTEM FOR INCREASING THE FUEL FEED IN INTERNAL COMBUSTION ENGINES DURING ACCELERATION

[75] Inventors: Harro Herth, Schwieberdingen, Fed. Rep. of Germany; Cornelius Peter, Paris, France; Hans Schnürle, Walheim, Fed. Rep. of Germany

[73] Assignee: Robert Bosch GmbH, Stuttgart, Fed. Rep. of Germany

[21] Appl. No.: 65,232

[22] Filed: Aug. 9, 1979

[30] Foreign Application Priority Data

Sep. 22, 1978 [DE] Fed. Rep. of Germany ..... 2841268

[51] Int. Cl.[3] ..... F02D 5/00

[52] U.S. Cl. ..... 123/492; 123/491; 123/493

[58] Field of Search ..... 123/492, 491, 493, 179 L, 123/438, 488

[56] References Cited

U.S. PATENT DOCUMENTS

| | | | |
|---|---|---|---|
| 3,673,989 | 7/1972 | Aono et al. | 123/179 L |
| 3,858,561 | 1/1975 | Aono | 123/492 |
| 4,010,717 | 3/1977 | Taplin | 123/492 |
| 4,126,107 | 11/1978 | Harada et al. | 123/492 |
| 4,148,283 | 4/1979 | Harada et al. | 123/491 |
| 4,191,137 | 3/1980 | Williams et al. | 123/492 |
| 4,205,635 | 6/1980 | Kirn et al. | 123/179 L |
| 4,231,333 | 11/1980 | Thatcher et al. | 123/438 |

*Primary Examiner*—Charles J. Myhre
*Assistant Examiner*—Andrew M. Dolinar
*Attorney, Agent, or Firm*—Edwin E. Greigg

[57] ABSTRACT

A system for increasing the fuel feed in internal combustion engines during acceleration in order to ensure better performance comprising an acceleration detector, an enrichment stage, a proportionating member associated with a differentiating member, all connected to be responsive to at least one sensing member whose output signal is variable according to the engine operating conditions. The operating parameters sensed may be, for example, speed, air flow rate in the intake manifold, starting conditions, as well as the temperature of the internal combustion engine.

21 Claims, 6 Drawing Figures

3b

3c

SYSTEM FOR INCREASING THE FUEL FEED IN INTERNAL COMBUSTION ENGINES DURING ACCELERATION

BACKGROUND OF THE INVENTION

This invention relates to a system for increasing the fuel feed in internal combustion engines during acceleration for optimal performance. The system includes an acceleration detector containing a differentiating member and an enrichment stage. Systems are known where the air flow meter signal is differentiated in a differentiating member and the output signal thereof determines the amount of fuel to be additionally injected into the intake manifold.

It has now been found, however, that it is impossible to obtain optimal results in driving comfort and acceleration enrichment when the fuel-air mixture is dependent solely on the rate of change of the air flow rate. Above all, this is true in cases of greatly differing speeds.

OBJECTS AND SUMMARY OF THE INVENTION

It is therefore an object of this invention to provide a system for maximizing the acceleration enrichment at any possible operating condition of the internal combustion engine.

The above object is attained according to the invention by providing an acceleration detector containing an enrichment stage having a differentiating member and a proportioning member associated with the differentiating member; all being responsive to a sensing member whose output is variable depending upon the operating conditions of the engine.

By having the time constant of the differentiating member dependent upon speed and/or air flow rate, or, preferably decreasing with increasing speed or increased air flow rate and by having the amplification factor of the proportioning member adjustable, depending upon the temperature or the starting condition of the engine, optimum fuel metering during acceleration is possible.

It is especially advantageous that if, in addition to the proportioning and differentiating member being responsive to the operating parameter of the engine, metered fuel feeding is increased during a coasting operation in order to compensate for any condensation losses on the inner surfaces of the intake manifold; these losses being a consequence of the drying process occurring due to high vacuum at the operating temperature of the intake manifold.

An additional advantage to the system will accrue if the proportioning and differentiating members have a control stage associated therewith to smooth the output signal from the air flow meter to avoid falsification due to pulsation of the air in the intake manifold.

This invention will be better understood as well as further objects and advantages thereof will become more apparent from the ensuing detailed description of the preferred embodiment taken in conjunction with the accompanying drawings.

DESCRIPTION OF THE PREFERRED EMBODIMENT

Figure 1:
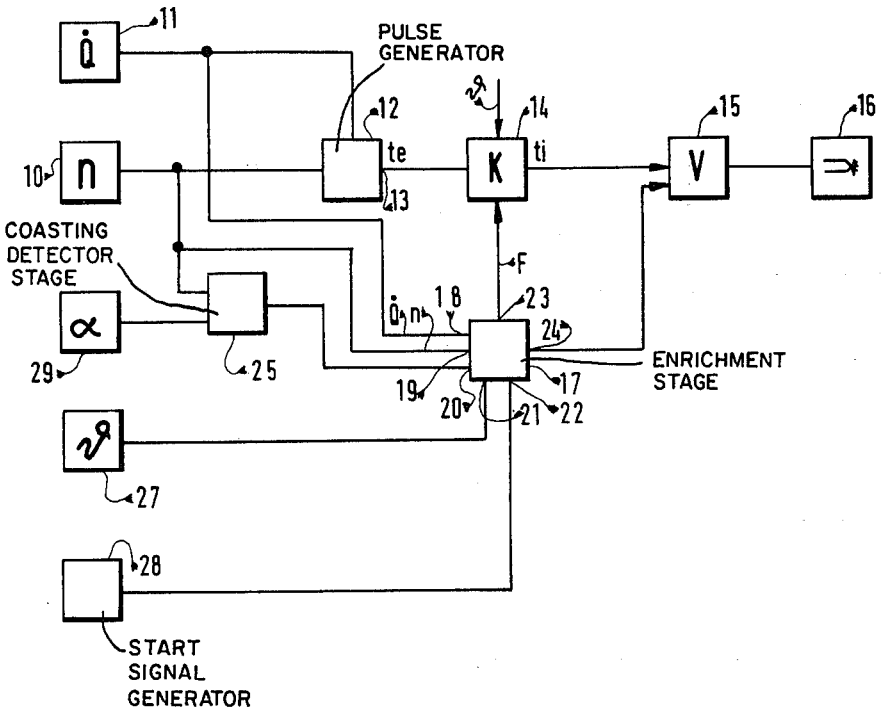
FIG. 1 is a schematic circuit diagram of a fuel injection arrangement in an internal combustion engine with spark ignition, with the device for acceleration enrichment indicated in block form.

FIG. 1 shows, in a schematic block circuit diagram, the electrical part of an injection means for an automotive vehicle with spark ignition. Numeral 10 denotes a speedometer and numeral 11 denotes an air flow meter. The output signals of both the speedometer 10 and the flow meter 11 are applied to a pulse generator stage 12, the output 13 of which is connected to a correction stage 14. An amplifier or driver stage 15 is connected between the correction stage 14 and an electromagnetically operated injection valve 16.

An acceleration enrichment stage is denoted by 17. This stage has five inputs 18 through 22, as well as two outputs 23 and 24. The input 18 is coupled to the output of the air flow meter 11, and the input 19 is connected to the output of the speedometer 10. An output signal from a coasting detector stage 25 is applied to the input 20 of the acceleration enrichment stage 17; the input 21 is coupled to a thermometer 27, and the input 22 is coupled to a start signal generator 28. The input variables for the coasting detector stage 25 are a signal from speedometer 10, as well as the output signal from a sensor 29 for the throttle valve opening angle.

The pulse generator stage 12 forms, starting with the output signals from speedometer 10 and air flow meter 11, an injection signal having the length te, which is corrected in the following correction stage 14 according to temperature and acceleration. The thus-corrected injection signal having the duration ti finally passes, via the driver stage 15, to the electromagnetic injection valve 16.

In the acceleration enrichment stage 17, an enrichment signal is formed for fuel metering. This signal depends on the operating condition of the internal combustion engine e.g. a starting operation, a coasting operation, the air flow rate in the air intake manifold, on the speed, as well as on temperature. The disclosed selection of operating conditions and parameters is merely exemplary. The extent to which data regarding the condition and operation of the internal combustion engine are processed in connection with the acceleration enrichment depends on the type of internal combustion engine selected as well as other factors. One example of additional data to be processed especially, is the output signal from an oxygen measuring probe in the exhaust pipe of the internal combustion engine.

Figure 2:
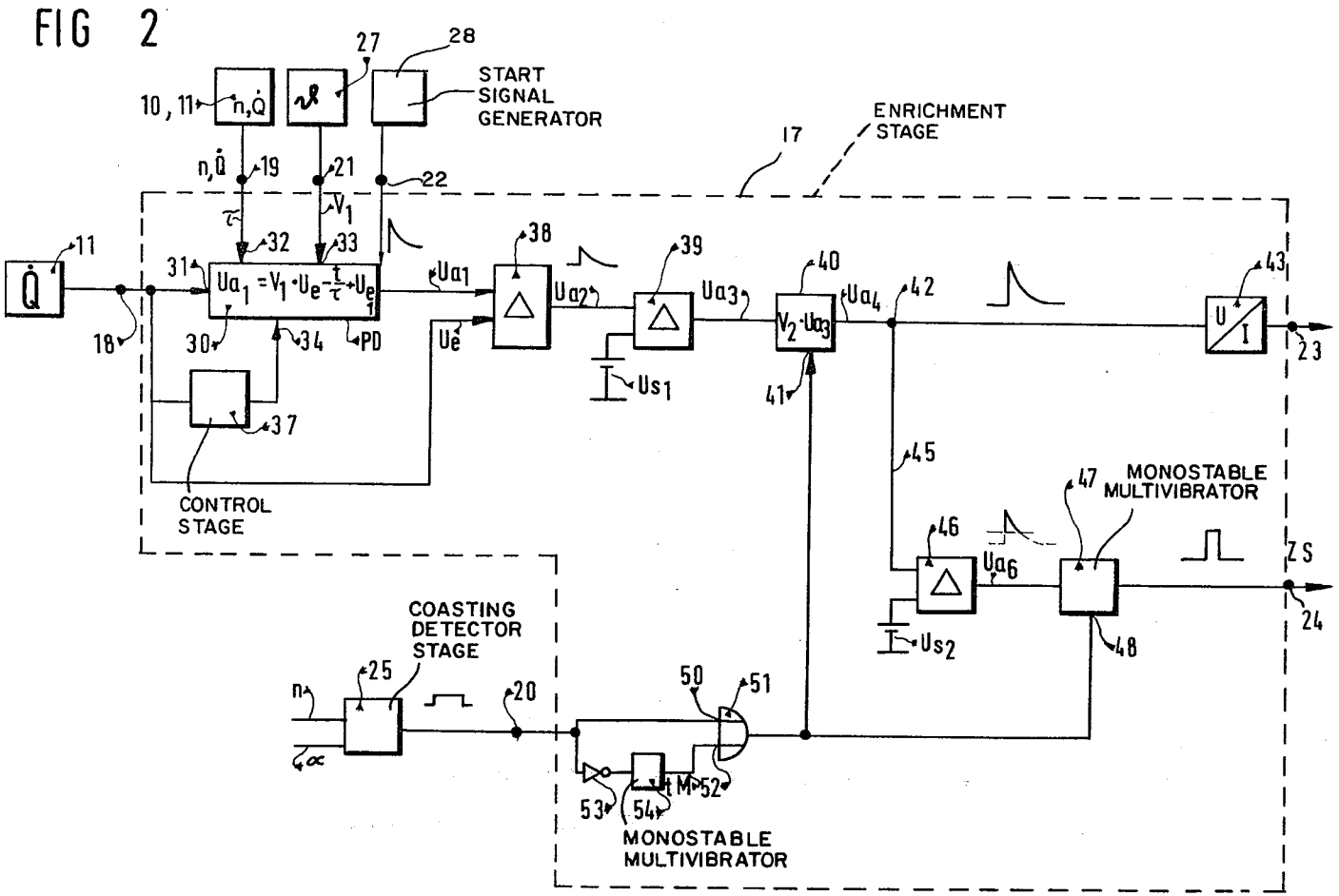
FIG. 2 shows a block circuit diagram of the device for acceleration enrichment of FIG. 1, FIG. *3a* through *3c* show pulse diagrams of the device of FIG. 2.

The block circuit diagram of the acceleration enrichment stage 17, indicated as a single block in FIG. 1, is shown in FIG. 2. Elements and points corresponding to those in FIG. 1 bear identical reference numerals.

The most essential component of the device of FIG. 2 is a combined proportioning-differentiating member, called a PD-member 30. This member operates in accordance with the function:

$$Ua_1 = V_1 \cdot \Delta Ue \cdot e - \frac{t}{\tau} + Ue_1$$

wherein $V_1$ indicates the amplification and $\tau$ the time constant of the differentiating member or, D-member.

In addition to a signal input 31, the PD-member 30 also has three control inputs 32, 33, and 34, as well as an output 35. The signal input 31 is coupled to the air flow meter 11 via the input 18. The control input 32, for affecting the time constant of the D-member within the PD-member 30, is coupled to the speedometer 10 and/or to the air flow meter 11. The amplification factor $V_1$, in contrast thereto, is affected by temperature being connected to thermometer 27 via the control input 33 and/or the signal from start signal generator 28.

In case of rapid changes in the air flow rate in the air intake manifold, there is the danger of a so-called pulsation, i.e. the air mass is set into vibration and this also affects the output signal of the air flow meter. An air flow meter output signal which is falsified because of pulsation, however, is to be avoided, so in the arrangement of FIG. 2, an additional control stage 37 to prevent pulsation affecting the output signal of the air flow meter, is provided. The output signal of control stage 37 acts on the PD-member 30 via the input 34. This control stage 37 serves to smooth the signal from the air flow meter 11, but in many instances, the output signal of the air flow meter 11 is itself smooth and thus free of such interference and is coupled directly into PD-member 30. An example of such a control stage is disclosed in U.S. Pat. No. 4,051,818.

The output 35 of the PD-member 30 is followed, in a series connection, by two comparison stages 38 and 39, wherein the first comparison stage 38 is additionally fed with the input signal of the PD-member 30. In the second comparison stage 39, the output signal of the preceding comparison stage 38 is compared with a fixed reference voltage $Us_1$. On the output side, the comparison stage 39 is connected to an amplifier stage 40, the amplification factor $V_2$ of which can be affected via a control input 41. A distribution point 42 follows, to which is applied an enrichment signal for acceleration; this enrichment signal being dependent on the operating condition and operating parameters. To lengthen the injection pulses during the acceleration phase, the distribution point 42 is connected via a voltage-current transformer 43 to the output 23 of the acceleration enrichment stage 17; this output being connected, in turn, to the correction stage 14 in accordance with the illustration of FIG. 1.

Furthermore, the signal from distribution point 42 passes via line 45 to a comparison stage 46 wherein the acceleration-dependent input signal is compared with a fixed voltage value $Us_2$. On the output side, the comparison stage 46 is coupled to a monostable multivibrator 47 wherein intermediate injection pulses are produced whose duration is dependent on the extent of the acceleration, and corresponding signals are made available at the output 24. For the additional control of the intermediate injection pulses the monostable multivibrator 47 has an additional control input 48. By means of an OR-gate in front of the driver stage 15 (FIG. 1), the intermediate injections pulses can finally be transmitted to the solenoid valves 16.

The acceleration process following a coasting operation of the internal combustion engine deserves special attention. Due to the coasting operation and the associated high vacuum in the air intake manifold, this space is thoroughly dried out so that condensation losses occur subsequent to the coasting operation especially in case of still cool internal combustion engines. To maintain these losses at a low level, the metering of fuel is increased following coasting operation.

For this reason, the coasting detector stage 25, described in connection with FIG. 1, is coupled to the acceleration enrichment stage 17. A first input 50 of an OR-gate 51 is directly connected to the input 20 of the acceleration enrichment stage 17, the second input 52 of this OR-gate being connected indirectly by way of a series connection of inverter 53 and monostable multivibrator 54 to the input 20. The output of the OR-gate 51 is connected to the control input 41 of the amplifier stage 40, as well as to the control input 48 of the monostable multivibrator 47.

The control of amplifier stage 40 and monostable multivibrator 47 according to the signal from the coasting operation detector stage regulates the amplification factor and the duration of the intermediate injection pulses in such a way that the enrichment signal present at the output 23 is larger and the intermediate injection pulse applied to output 24 is longer during acceleration processes during and after the coasting operation. The OR-gate 51, together with the monostable multivibrator 54, serves to effect a corresponding timing control, wherein this multivibrator 54 is triggered by the descending flank of the coasting detector signal from the output of the coasting operation detector stage 25. This ensures that an increased metered fuel feed occurs immediately at the end of the coasting operation.

The last-mentioned circuit arrangement with OR-gate 51 results in a digital enrichment of the mixture for acceleration at the end of the coasting operation. However, it may be advantageous to diminish this additional enrichment pulse according to certain mathematical functions, which is possible, for example, in case of an exponential function with the aid of a capacitor as the energy storage means.

Figure 3A:
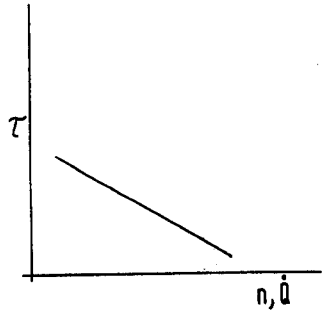
Figure 3A:
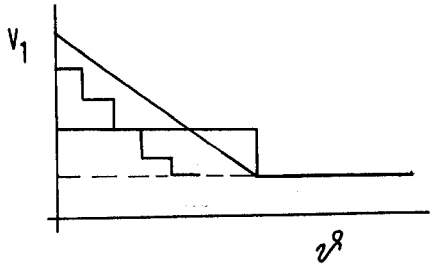
Figure 3A:
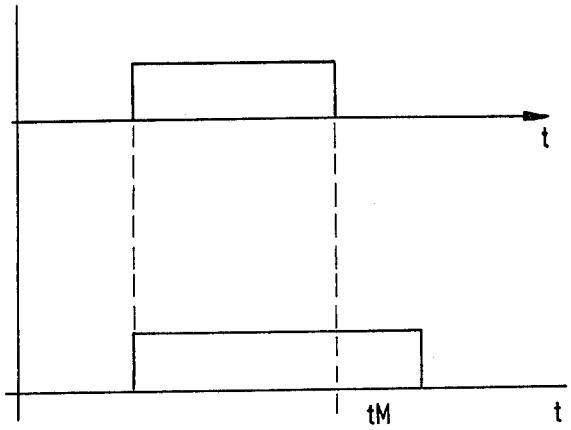

FIG. 3 shows three diagrams in connection with the circuit arrangement of FIG. 2. Thus, in FIG. 3*a*, the value of the time constant of the PD-member 30 is plotted against speed and/or the air flow rate in the intake manifold, in the form of a straight line descending toward higher values. This means that the trailing edge of the output signal pulse of the PD-member 30 has a smaller $\tau$ at higher speeds and thus effects control more rapidly. Alternatively, the time constant can be varied curvilinearly or in a stepped fashion.

FIG. 3*b* shows the amplification factor of the PD-member 30 as a function of the temperature of the lubricating oil and of the cooling fluid, respectively. This curve, too, shows a ramp function as well as a stepped function. Alternatively, a curvilinear function may be employed. The particular curve configuration selected depends on its desirability or necessity.

FIG. 3*c* shows, first, the output signal of the coasting detector stage 25 and the output signal of the OR-gate 51 which differs from the output signal of the coasting detector stage 25 in that an additional and constant time interval of the duration tM is additionally present.

Figure 4:
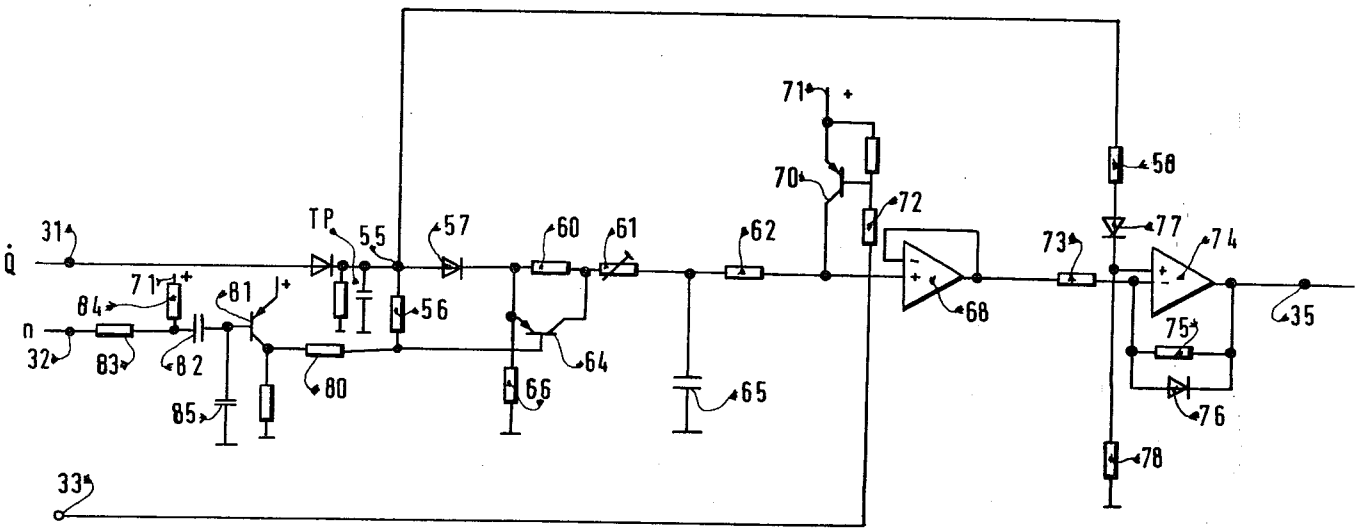
FIG. 4 shows an embodiment of the most important block of the arrangement of FIG. 2.

FIG. 4 shows a detailed circuit diagram of the PD-member 30.

The signal input 31 is coupled via a low-pass filter TP, with a diode 49 connected in front thereof, to a branch point 55 to which are connected a resistor 56, the anode of a diode 57, as well as a further resistor 58. The diode 57 is followed by a series circuit of three resistors 60, 61, and 62, the emitter-collector path of a transistor 64 being connected in parallel to resistor 60, and a capacitor 65 being connected to ground from the connection point of resistors 61 and 62. The collector of transistor 64 is connected to ground via a resistor 66, the base of this transistor being connected to resistor 56. The resistor 62 is followed by an operational amplifier 68, connected with negative feedback, to serve as an impedance transformer. In addition to resistor 62, the collector of a transistor 70 is also connected to the positive input of this amplifier 68. The emitter of transistor 70 is coupled to a positive voltage source 71, and the base of this transistor is fed with the control signal from the input 33 of PD-member 30 via a resistor 72.

On the output side, the impedance transformer 68 is connected via a resistor 73 to the negative input of an operational amplifier 74. This operational amplifier 74 is provided with negative feedback by means of a parallel circuit made up of resistor 75 and diode 76. The positive input of this amplifier is connected to the junction point of diode 77 and resistor 78, with the other side of resistor 78 being connected to ground and the anode of diode 77 being connected to resistor 58. The output of the operational amplifier 74 constitutes the output 35 of the PD-member 30.

The transistor 64 is controlled on its base side, via a resistor 80, by the collector of a transistor 81. This transistor 81 is controlled, via a capacitor 82 and a resistor 83, by the control input 32 of the PD-member 30. From a positive line 71, a resistor 84 is additionally connected to the junction point of capacitor 82 and resistor 83, and additionally a capacitor 85 is connected to ground from the base of transistor 81.

The differentiating circuit section in the arrangement of FIG. 4 consists of the operational amplifier 74 and the capacitor 65. The differentiating behavior is obtained by the fact that the signal at the negative input of the operational amplifier 74 cannot rise, due to the capacitor 65, as rapidly as the signal at the positive input of the operational amplifier. The way in which the signal increases via capacitor 65 is determined by the speed signal at input 32, because this speed signal effects a short-circuiting of resistor 60 by means of transistor 64. The linear portion of the effect exerted on the PD-member 30 is determined by the signal at input 33, which is dependent on the temperature and, in case of starting, suppresses any enrichment.

The control stage 37 to prevent pulsation affecting the signal from the air flow meter, as shown in FIG. 2, is not provided in the arrangement of FIG. 4. This entails the prerequisite in FIG. 4 that the air flow rate signal at input 31 has already been filtered and smoothed.

The remaining components of the arrangement of FIG. 4 are commercially available and well known to those skilled in the art so that a separate description of these components is unnecessary.

One modification possibility for the circuit arrangement of FIG. 4 resides in that, via the input 32, an air flow rate signal can become effective in addition to or instead of the speed signal. It is furthermore also possible to additionally control the electric characteristics of the individual components so as to be responsive to additional operating parameters, to thus be able to optimize the acceleration behavior of the automotive vehicle equipped with the internal combustion engine with respect to further aspects.

The foregoing represents a preferred exemplary embodiment of the invention, it being understood that variants thereof are possible within the spirit and scope of the invention, the latter being defined by the appended claims.

What is claimed and desired to be secured by Letters Patent of the United States is:

1. A system for increasing the fuel feed during acceleration, in an internal combustion engine having a throttle valve and an injection valve, pulse signal generating means connected to generate a pulse signal to the injection valve, the system including:

a coasting detector stage connected to the throttle valve and the engine which generates a signal indicating vehicle coasting, as a function of throttle valve angle and engine rpm;

a means which generates a time constant according to engine rpm;

means for detecting acceleration including an enrichment stage having a differential member and proportional member, wherein the differential member is connected to the means which generates a time constant to receive a time constant and to generate a differential output depending on the time constant, and wherein the proportional member is connected to the differential member to receive the differential output and to generate a signal proportional thereto, and wherein the enrichment stage is connected to the pulse signal generating means and to the coasting detector stage to receive the signal indicating vehicle coasting, such that the pulse signal generating means generates a lengthened pulse signal which is received by the injection valve to provide prolonged fuel injection by the injection valve in response to the coasting signal.

2. A system for increasing the fuel feed during acceleration, in an internal combustion engine having a throttle valve and an injection valve, pulse signal generating means connected to generate a pulse signal to the injection valve, the system including:

a coasting detector stage connected to the throttle valve and the engine which generates a signal indicating vehicle coasting, as a function of throttle valve angle and engine rpm;

a means which generates a time constant according to air flow rate in the engine;

means for detecting acceleration including an enrichment stage having a differential member and proportional member, wherein the differential member is connected to the means which generates a time constant to receive a time constant and to generate a differential output depending on the time constant, and wherein the proportional member is connected to the differential member to receive the differential output and to generate a signal, proportional thereto, and wherein the enrichment stage is connected to the pulse signal generating means and to the coasting detector stage to receive the signal indicating vehicle coasting, such that the pulse signal generating means generates a lengthened pulse signal which is received by the injection valve to provide prolonged fuel injection by the injection valve in response to the coasting signal.

3. A system for increasing the fuel feed during acceleration, in an internal combustion engine having a throttle valve and an injection valve, pulse signal generating means connected to generate a pulse signal to the injection valve, the system including:

a coasting detector stage connected to the throttle valve and the engine which generates a signal indicating vehicle coasting, as a function of throttle valve angle and engine rpm;

a means which generates a time constant according to air flow rate in the engine and engine rpm;

means for detecting acceleration including an enrichment stage having a differential member and proportional member, wherein the differential member is connected to the means which generates a time constant to receive a time constant and to generate a differential output depending on the time constant, and wherein the proportional member is connected to the differential member to receive the differential output and to generate a signal, proportional thereto, and wherein the enrichment stage is connected to the pulse signal generating means and to the coasting detector stage to receive the signal indicating vehicle coasting, such that the pulse signal generating means generates a lengthened pulse signal which is received by the injection valve to provide prolonged fuel injection by the injection valve in response to the coasting signal.

4. The system according to claim 3, wherein the time constant decreases with at least one of an increasing engine speed and an increasing air flow rate.

5. The system according to claim 1, 2 or 3, wherein the proportioning member has an amplification factor which is adjustable in response to at least one of the temperature and a starting condition of the internal combustion engine.

6. The system according to claim 1, 2 or 3, wherein the proportioning member has an amplification factor determined by a least one engine condition, and wherein the time constant and the amplification factor can be varied linearly.

7. The system according to claim 1, 2 or 3, wherein the pulse signal generating means includes a correction stage for normal fuel metering signals and an intermediate stage, and wherein the proportioning and differentiating member combined are connected with the correction stage and with the intermediate injection stage.

8. The system according to claim 1 wherein the time constant decreases with an increasing engine rpm.

9. The system according to claim 2 wherein the time constant decreases with an increase in the air flow rate.

10. The system according to claim 1, 2 or 3 wherein the proportioning member has an amplification factor which is adjustable at least in response to the temperature of the internal combustion engine.

11. The system according to claim 10, wherein means are provided for additionally increasing the fuel feed in case of acceleration immediately after a coasting operation.

12. The system according to claim 11, wherein the coasting detector stage is coupled to the enrichment stage to accomplish such additional increase in fuel feed.

13. The system according to claim 12 also including an intake manifold; an air flow meter located in the intake manifold which generate an air flow signal, wherein a control stage is associated with the porportionating and differentiating members to prevent falsification of the signal from the air flow meter due to pulsation of the air in the intake manifold.

14. The system according to claim 13, wherein a low-pass filter is connected between the combined proportioning and differentiating members and the air flow meter.

15. The system according to claim 1, 2 or 3 wherein the proportioning member has an amplification factor which is adjustable at least in response to the starting condition of the internal combustion engine.

16. The system according to claim 15, wherein means are provided for additionally increasing the fuel feed in case of acceleration immediately after a coasting operation.

17. The system according to claim 16, wherein the coasting detector stage is coupled to the enrichment stage to accomplish such additional increase in fuel feed.

18. The system according to claim 17 also including an air intake manifold; an air flow meter located in the intake manifold which generates an air flow signal, wherein a control stage is associated with the proportionating and differentiating members to prevent falsification of the signal from the air flow meter due to pulsation of the air in the intake manifold.

19. The system according to claim 18, wherein a low-pass filter is connected between the combined proportionating and differentiating members and the air flow meter.

20. The system according to claim 1, 2 or 3, wherein the proportioning member has an amplification factor determined by at least one engine condition, and wherein the time constant and the amplification factor can be varied curvilinearly.

21. The system according to claim 1, 2 or 3, wherein the proportioning member has an amplification factor determined by at least one engine condition, and wherein the time constant and the amplification factor can be varied in a stepped fashion.

* * * * *